US006152788A

United States Patent [19]

Hata et al.

[11] Patent Number: 6,152,788

[45] Date of Patent: Nov. 28, 2000

[54] FEMALE TERMINAL

[75] Inventors: Takao Hata; Shinichi Yamada, both of Yokkaichi, Japan

[73] Assignee: Sumitomo Wiring Systems, Ltd., Mie, Japan

[21] Appl. No.: 09/440,718

[22] Filed: Nov. 16, 1999

[30] Foreign Application Priority Data

Jan. 20, 1999 [JP] Japan ..... 11-012321

[51] Int. Cl.[7] ..... H01R 11/22

[52] U.S. Cl. ..... 439/852; 439/51

[58] Field of Search ..... 434/851–853, 434/842, 843, 844, 845, 849, 861

[56] References Cited

U.S. PATENT DOCUMENTS

| | | | |
|---|---|---|---|
| 5,226,842 | 7/1993 | Endo et al. | 439/852 |
| 5,443,592 | 8/1995 | Ihah et al. | 439/851 |
| 5,575,696 | 11/1996 | Endo et al. | 439/852 |
| 5,611,715 | 3/1997 | Samajima | 439/851 |
| 5,630,738 | 5/1997 | Ito et al. | 439/852 |
| 5,643,018 | 7/1997 | Sakai et al. | 439/852 |
| 5,788,542 | 8/1998 | Miva | 439/851 |
| 5,839,925 | 11/1998 | Simmons | 439/852 |

FOREIGN PATENT DOCUMENTS

| | | |
|---|---|---|
| 59-39876 | 3/1984 | Japan . |
| 3-685 | 1/1991 | Japan . |

*Primary Examiner*—Hien Vu
*Attorney, Agent, or Firm*—Oliff & Berridge, PLC

[57] ABSTRACT

An elastic contact piece is formed from a front edge of a bottom portion forming a box-shaped body part. A contact portion extended from a side edge of the elastic contact piece faces a window hole formed on a side wall. In a stopper forming a lower edge of the window hole, a receiving portion is formed on a cut-off portion in such a manner that a lengthwise center portion of the cut-off portion tapers off inward. Because the contact portion is received by the receiving portion of the stopper, the elastic contact piece is prevented from deforming excessively. At this time, the contact portion is received in a wide range as far as a deep portion thereof by the receiving portion tapering off inward. Thus, the force acting on the contact portion can be dispersed.

2 Claims, 6 Drawing Sheets

FEMALE TERMINAL

BACKGROUND OF THE INVENTION

1. Field of Invention

The present invention relates to a female terminal having a function of preventing an excessive deformation of an elastic contact piece.

2. Description of Related Art

A female terminal having an excessive flexure-preventing construction is disclosed in Examined Japanese Utility Model Application Publication No. 59-3987. As shown in FIG. 6, a window hole is formed on both side walls (b) of a box-shaped body part (a), and a contact portion (e) is extended at both side edges of an elastic contact piece (d) such that an end portion of the contact portion (e) faces the window hole (c). When the elastic contact piece (20) is flexed, the contact portion (e) is brought into contact with the lower edge of the window hole (c) to prevent the elastic contact piece (d) from deforming excessively.

In the female terminal of the above-described type, the lower edge of the window hole (c) serving as a receiving portion is a part of the side wall (b). Thus, the window hole (c) has a high degree of strength, whereas the contact portion (e) is easily deformed or bent from its root portion because a small portion of the contact portion (e) contacts the elastic contact piece (d) and thus a force concentrates thereon.

The deformation of the contact portion (e) can be prevented by enlarging the contact portion (e) and the window hole (c) so that the contact portion (e) is received in a wide area to disperse the force. But when the window hole (e) is enlarged, the strength of the side wall (b) is reduced.

A female terminal is also disclosed in Examined Japanese Utility Model Application Publication No. 3-685. As shown in FIG. 7, in the female terminal, a side wall (g) is cut to form a receiving piece (h) projecting inward. The receiving piece (h) receives the side edge of an elastic contact piece (i). Because the elastic contact piece (i) is received in a wide area, the amount of deformation of the elastic contact piece (i) is small. But the receiving piece (h) is easily flexed and thus has a low degree of strength.

SUMMARY OF THE INVENTION

The present invention has been made in view of the above-described problem. Therefore, it is an object of the present invention to provide a female terminal having a construction high in strength and preventing an elastic contact piece from being flexed excessively.

To solve the above-described problem, there is provided a female terminal having a box-shaped body part and an elastic contact piece formed by folding a front end of the body art inward. A metal tab of a mating male terminal is inserted into the body part from a front end thereof by flexing the elastic contact piece to allow the tab to elastically contact the elastic contact piece. A side wall has a stopper that contacts a contact portion formed on a side edge of the elastic contact piece and prevents the elastic contact piece from being flexed excessively. The stopper is embossed inward by cutting off a portion of the stopper from the side wall. A receiving portion is formed on a cut-off portion in such a manner that a lengthwise center portion of the cut-off portion tapers off inward.

In accordance with an aspect of the invention, the contact portion extends from the side edge of the elastic contact piece. A window hole faced by the window hole is formed on the side wall of the body part. The stopper having the receiving portion whose lengthwise center portion tapers off inward is formed by inwardly embossing a front edge portion of the window hole in a flexing direction of the elastic contact piece.

A portion of the stopper is cut off from the side wall to form the receiving portion on the cut-off portion in such a manner that the lengthwise center portion of the cut-off portion tapers off inward. Thus, the contact portion of the elastic contact piece can be received in a wide range as far as a deep portion thereof. That is, the force acting on the contact portion can be dispersed. Consequently, it is possible to prevent the contact portion from deforming. Further, because a portion of the stopper is cut off from the side wall, the force acting on the stopper is supported by the side wall through a connected portion thereof. Thus, the stopper has a high degree of strength. In addition, because a large hole is not formed on the side wall, the side wall, is allowed to have a high degree of strength.

The contact portion is supported by the receiving portion of the stopper in a wide range as far as a deep portion thereof although the window hole is not large. Thus, it is possible to minimize the area of the window hole and increase the strength of the stopper and the side wall effectively.

DETAILED DESCRIPTION OF PREFERRED EMBODIMENTS

Figure 1:
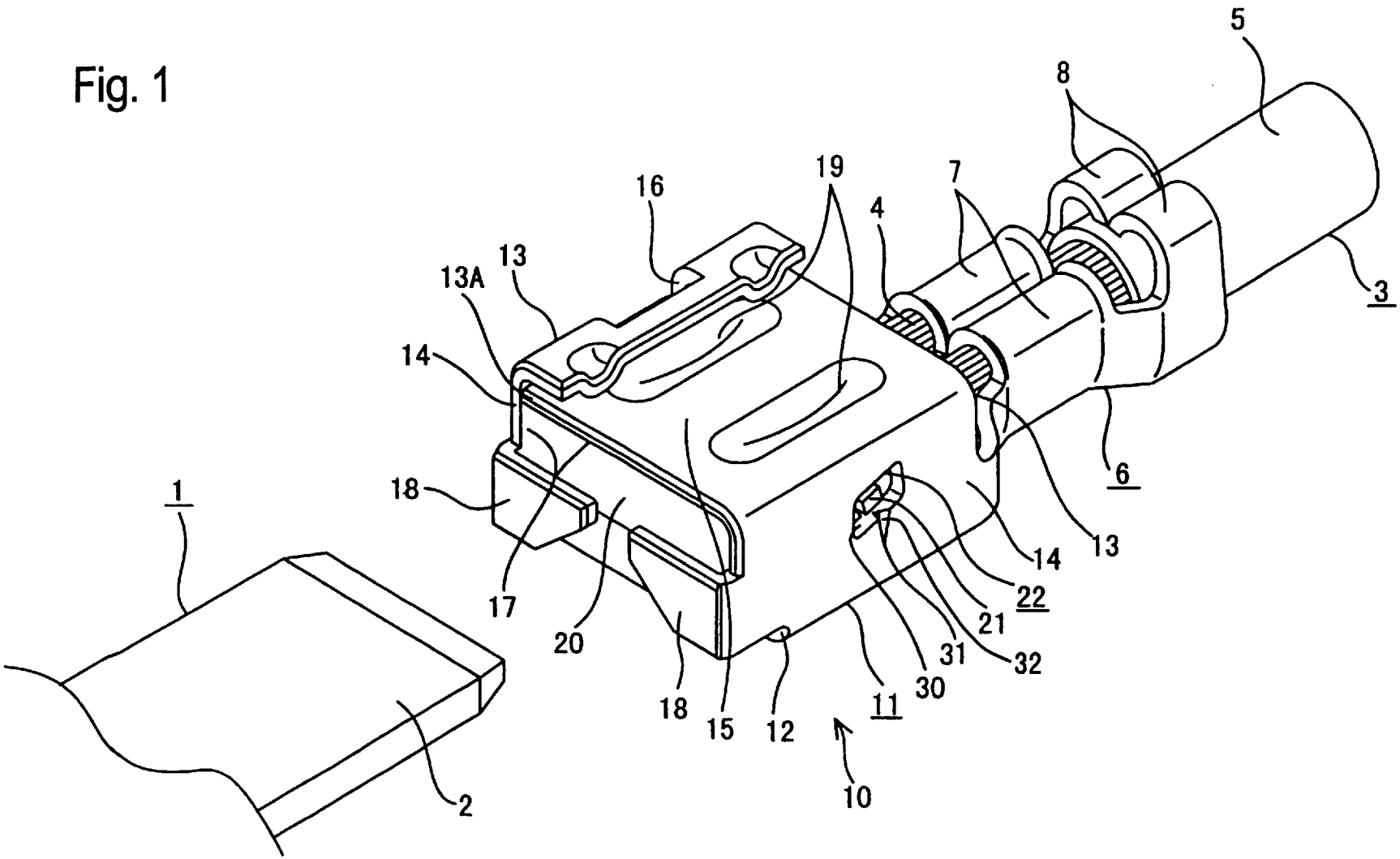
FIG. 1 is a perspective view showing a female terminal and a male terminal according to a first embodiment of the present invention.

An embodiment of the present invention will be described below with reference to FIGS. 1 through 5. A female terminal 10 of the embodiment is formed by bending an electrically conductive metal plate. As shown in FIG. 1, the female terminal 10 includes a body part 11 formed of a long plate (which forms the majority of body part 11) and a short plate 13 in which a male terminal 1 and a tab 2 are connected with each other; and a barrel part 6 in which a core wire 4 is crimped onto a terminal portion of an electric wire 3. The barrel part 6 is formed of a wire barrel 7 caulked to the core wire 4 and an insulation barrel 8 arranged adjacently to the wire barrel 7 and caulked to a covering 5.

The body part 11 is approximately box-shaped. A short plate 13 extends sideways from both side edges of a bottom portion 12 of the body part 11. By bending the short plate 13 upward, a side wall 14 is formed. By inwardly bending the long plate at one side of the body part 11, an upper wall 15 is formed. The short plate 13 at the other side of the body part 11 is folded back on the upper wall 15. A cut-out 16 is formed at the center of the short plate 13 on the other side of the body part 11. An end portion 13A of the short plate 13 at one side of the body part 11 is fitted in the cut-out portion 16 to connect both the long plate and the short plate plates 13 with each other. An open portion 17 is formed at the front of the body part 11. The tab 1 of the male terminal 1 is inserted rearward into the open portion 17.

Figure 2:
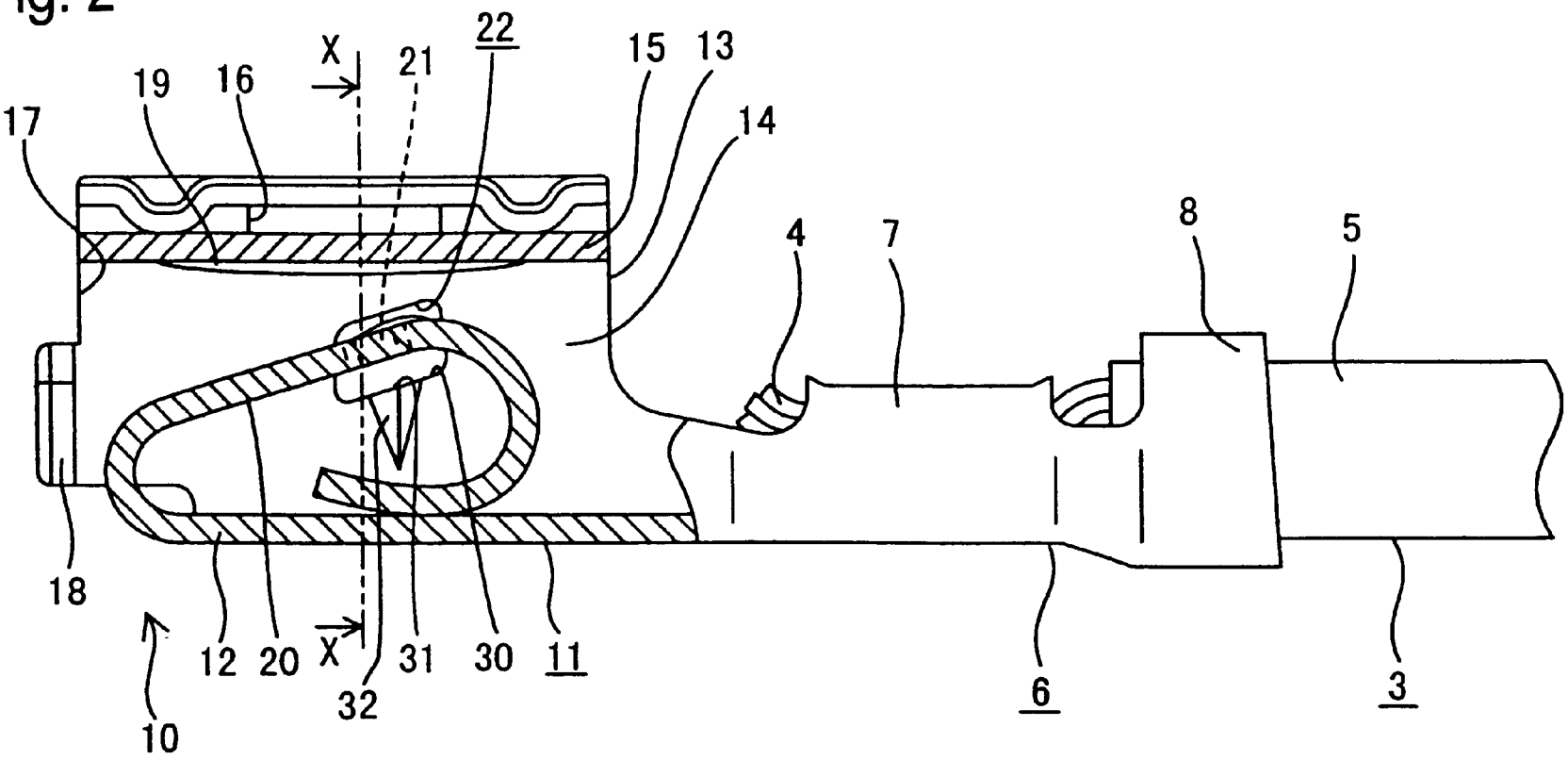
FIG. 2 is a partly cut-out side view showing the female terminal of FIG. 1.

The lower half of the open portion 17 is closed with a regulation piece 18 formed on a front portion of both side walls 14. The regulation piece 18 regulates, by steering the insertion of the tab 1 of the male terminal 1 into the upper half of the open portion 17. As shown in FIG. 2, a tongue-shaped elastic contact piece 20 extends rearward from the front end of the bottom portion 12 of the body part 11 and is folded forward in the body part 11. The elastic contact piece 20 is formed obliquely upwardly from the front end of the bottom portion 12, bent obliquely downwardly, and then folded forward such that it contacts the bottom portion 12. The tab 2 of the male terminal I can be inserted into the upper half of the open portion. The upper wall 15 has two bulged portions 19 extending inward (downward) therefrom. The bulged portion 19 contacts the tab 2 at a high pressure (see FIG. 1).

Figure 3:
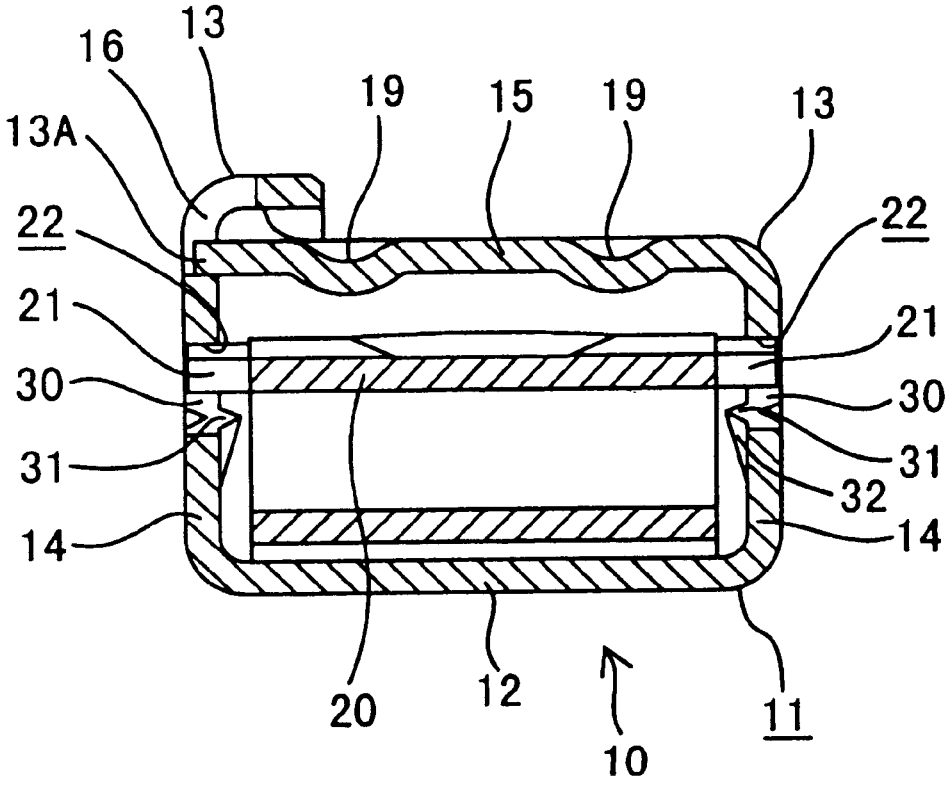
FIG. 3 is a sectional view taken along a line X—X of FIG. 2.

A window hole 22 is formed on the side wall 14 of the body part 11. The window hole 22 is so formed obliquely upwardly, i.e., it becomes gradually higher toward its rear portion. At a position near the top portion of the elastic contact piece 20, a contact portion 21 is extended from both side edges of the elastic contact piece 20, such that the contact portion 21 faces the window hole 22 (see FIG. 3). The contact portion 21 is capable of contacting an edge portion of the lower side of the window hole 22 and thus, prevents the elastic contact piece 20 from being flexed downward excessively (from being forced excessively in the downward direction). A part of the side wall 14 which contacts the contact portion 21 is a stopper 30. As shown in FIG. 3, from about the center portion of the inner surface of the side wall 14, a part of which serves as the stopper 30. The triangular portion, the cut-off portion 32, formed from the tapering of the stopper, is the receiving portion of the stopper and the embossing of the stopper from the outside of the side wall and provides further support to the contact portion to prevent excessive defamation of the elastic contact piece.

Figure 4:
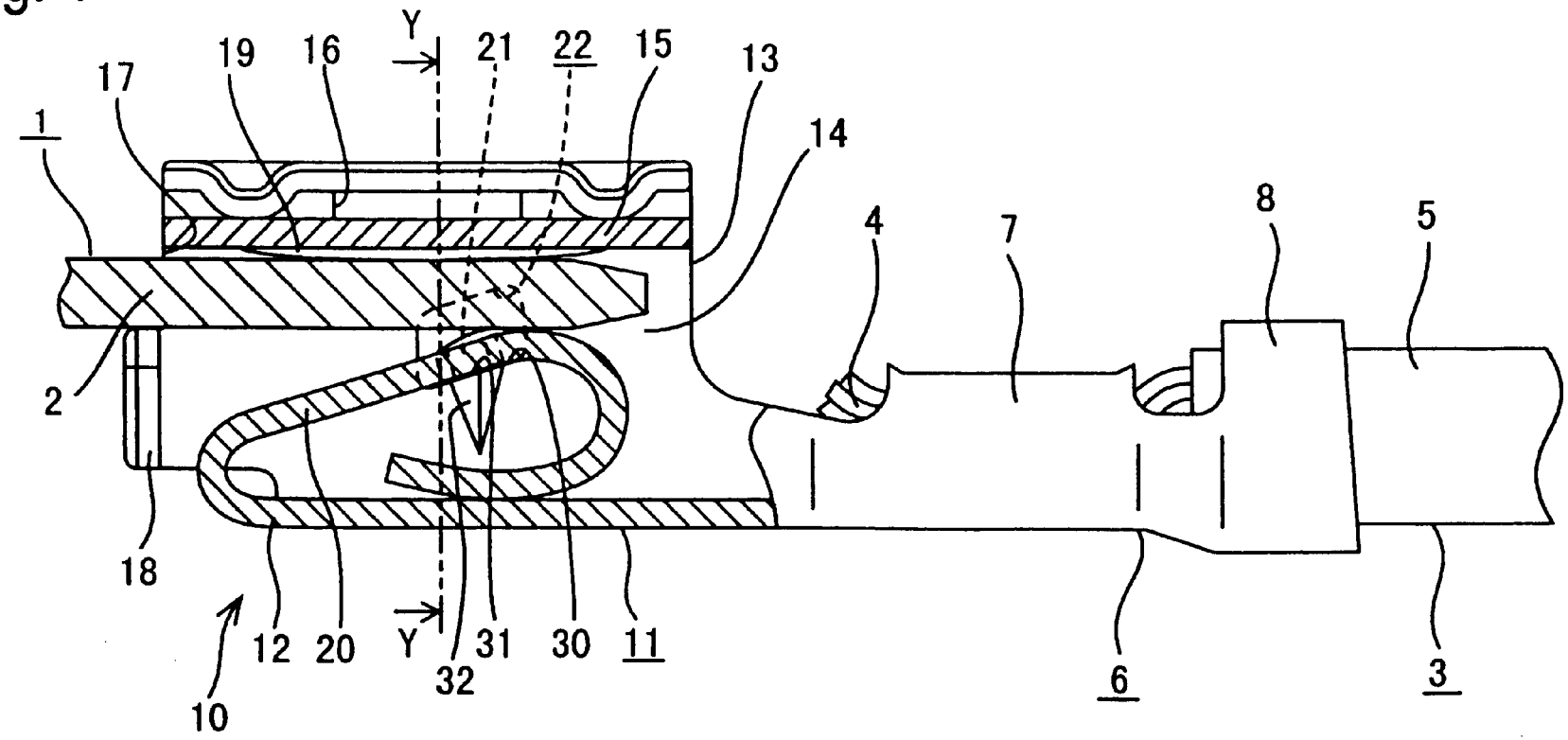
FIG. 4 is a partly cut-out side view showing the female terminal connected with a tab of the male terminal.
Figure 5:
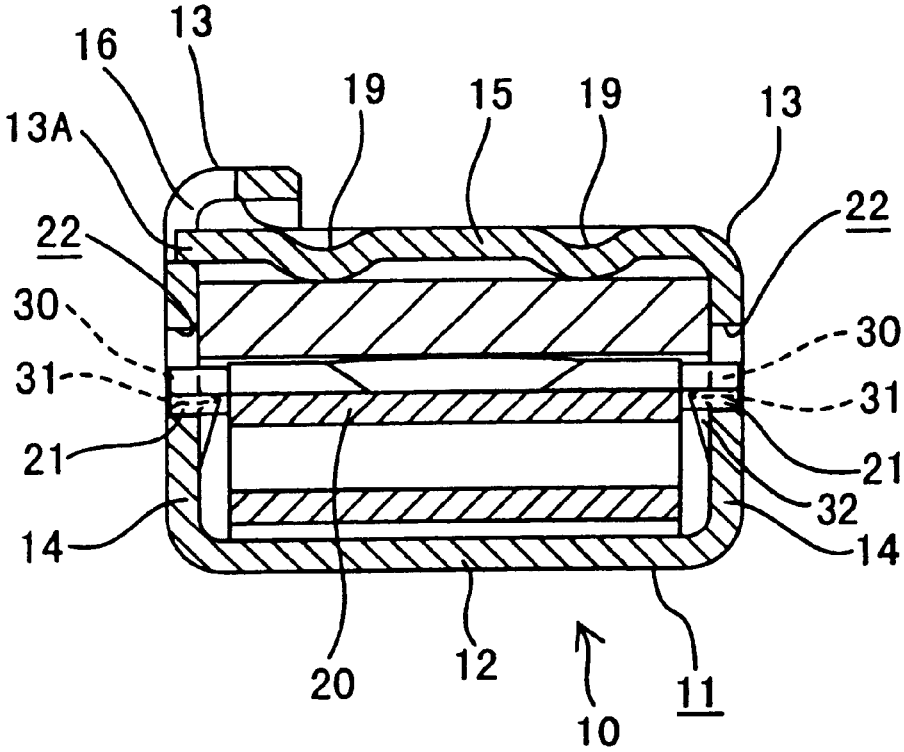
FIG. 5 is a sectional view taken along a line Y—Y of FIG. 4.
Figure 6:
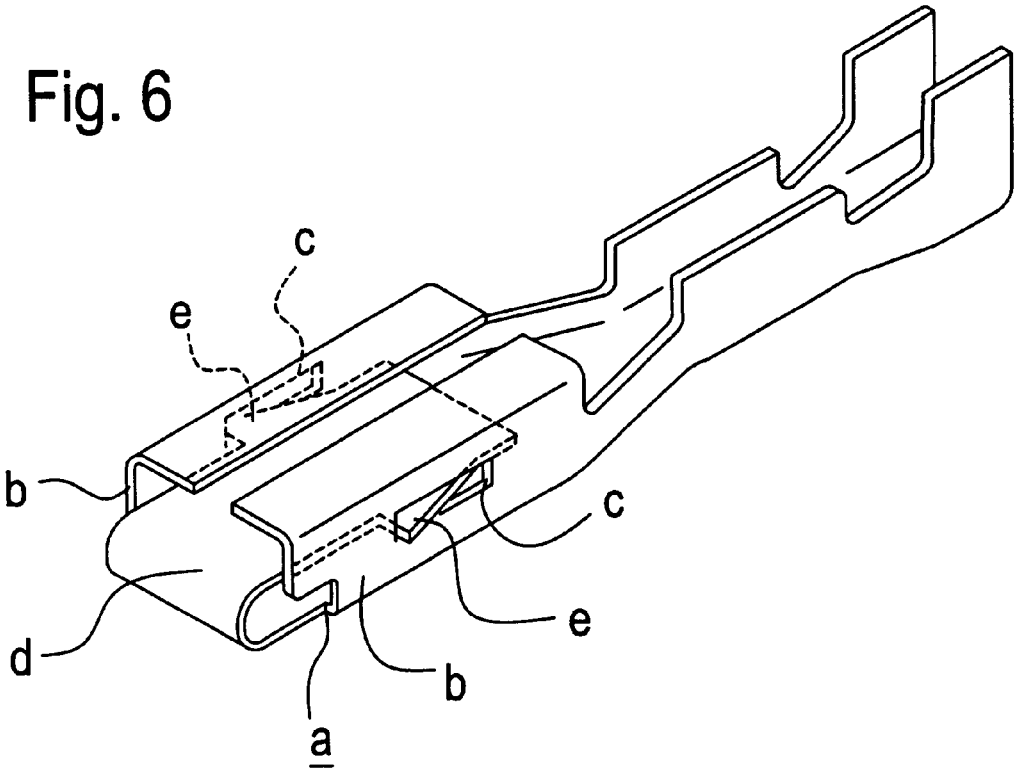
FIG. 6 is a perspective view showing a conventional female terminal.
Figure 7:
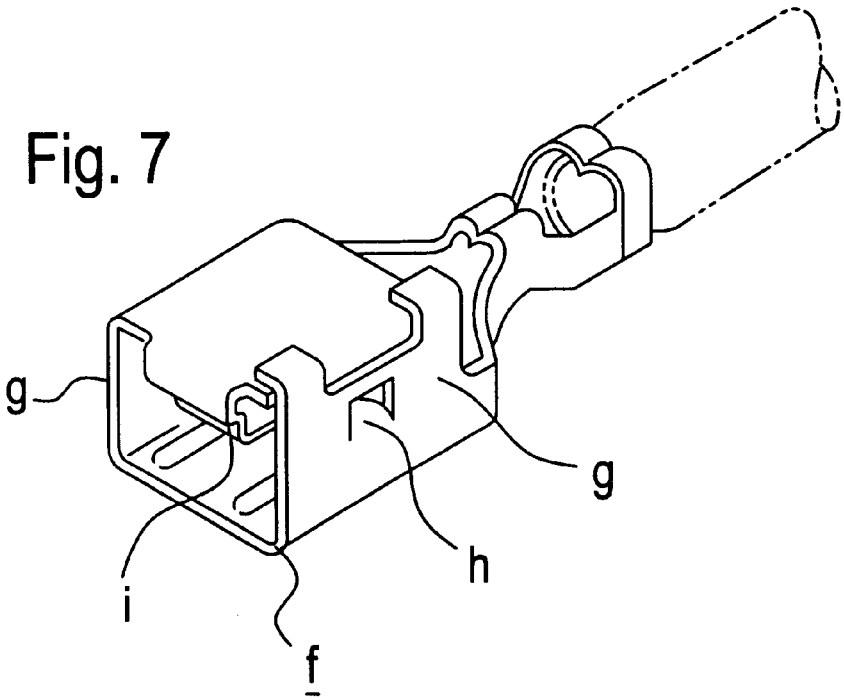
FIG. 7 is a perspective view showing another conventional female terminal.

The operation of the embodiment thus constructed will be described below. The tab 2 of the male terminal 1 is inserted into the body part 11 from the open portion 17 formed at the front of the body part 11 of the female terminal 10. The inserted tab 2 is pressed rearward while it is in contact with the bulged portion 19 of the upper wall 15 and contacts the top portion of the elastic contact piece 20. As a result, the elastic contact piece 20 is flexed downward, as shown in FIGS. 4 and 5. At this time, the tab 2 is held between the elastic contact piece 20 and the bulged portion 19 of the upper wall 15 by an elastic force generated on the elastic contact piece 20. In this manner, the female terminal 10 and the male terminal 1 are electrically connected with each other.

The tab 2 of the male terminal 1 may be inserted into the body part 11 obliquely downwardly or a jig may be inserted thereinto erroneously and dashed against the elastic contact piece 20. The downward flexing degree of the elastic contact piece 20 in such a case is higher than the downward flexing degree of the tab 2 in a normal case (case where the tab 2 is normally inserted into the body part 11).

In this case, when the elastic contact piece 20 is flexed to a predetermined position, the contact portion 21 contacts the receiving portion 31 of the stopper 30 formed on the edge of the lower side of the window hole 22. A downward force applied to the elastic contact piece 20 acts on the receiving portion 31 of the stopper 30 through the contact portion 21. The receiving portion 31 is triangular and projecting inward in the body part 11. Thus, even a deep portion of the contact portion 21 is supported by the receiving portion 31. That is, the contact portion 21 is received by the receiving portion 31 in a wide range. Thus, a receiving force is prevented from being locally applied to the contact portion 21. Therefore, it is possible to prevent the root portion of the contact portion 21 from deforming or breaking and the elastic contact piece 20 from being flexed excessively.

Because the receiving portion 31 of the stopper 30 is formed by embossing the side wall 14, the force that is applied to the receiving portion 31 by the contact portion 21 is supported by the side wall integral with the stopper 30. That is, the receiving strength of the stopper 30, namely, the side wall 14 can be kept at a high degree. Further, the receiving range of the contact portion 21 can be secured widely without enlarging the window hole 22. Thus, it is possible to keep the strength of the stopper 30 and the side wall 14 at a high degree.

As described above, according to the embodiment, the stopper 30 has the receiving portion 31 whose lengthwise center portion projects inward in the body part 11. The receiving portion 31 receives the contact portion 21 of the elastic contact piece 20 excessively deformed. Thus, the contact portion 21 is received in a wide range. That is, the force acting on the contact portion 21 can be dispersed. Consequently, it is possible to prevent the contact portion 21 from deforming and the elastic contact piece 20 from being flexed excessively. Further, because the receiving portion of the contact portion 21 can be secured widely, it is possible to minimize the area of the window hole 22 and increase the strength of the stopper 30 and the side wall 14 effectively.

While the invention has been described in conjunction with the specific embodiments described above, many equivalent alternatives, modifications and variations will become apparent to those skilled in the art once given this disclosure. Accordingly, the preferred embodiments of the invention as set forth above are considered to be illustrative and not limiting. Various changes to the described embodiments may be made without departing from the spirit and scope of the invention.

In addition to the above-described embodiment, it is possible not to form the window hole and form the triangular receiving portion projecting inside the body part by punching the side wall. In this case, the side wall has a high degree of strength because no window hole is formed therethrough.

Further, the contact portion is not necessarily extended from the elastic contact piece but the side edge thereof may be formed as the contact portion.

What is claimed is:

1. A female terminal for use with a mating male terminal that has a metal tab, the female terminal comprising:

a box-shaped body part having a front end;

a side wall having an inner surface, an outer surface, a window hole having a lower side, and a stopper that is formed on the outer surface of the side wall and is tapered in a downward direction to form a receiving portion and a cut-off portion, said receiving portion of the stopper being above the cut-off portion of the stopper, wherein the cut-off portion has a lengthwise portion that is tapered inwardly; and an elastic contact piece having a side edge and a contact portion formed on the side edge, the elastic contact piece being formed via inwardly folding the front end of the box-shaped body part such that inserting the metal tab of the mating male terminal into the front end of the box-shaped body part results in elastic contact and flexing of the elastic contact piece;

wherein the the contact portion contacts the receiving portion of the stopper, said stopper formed on an edge of the lower side of the window hole, so as to limit flexation of the elastic contact piece.

2. The female terminal according to claim 1, wherein said contact portion extends from said side edge of said elastic contact piece; the box-shaped body part has the side wall that defines a window hole that has a front edge portion; and the lengthwise center portion of the receiving portion is formed by inwardly embossing the front edge portion of said window hole in a direction of flexation of said elastic contact piece.

* * * * *